United States Patent [19]

Wagner et al.

[11] 4,030,328

[45] June 21, 1977

[54] DEVICE FOR CONTINUOUS LUBRICATION OF AN EXTRUSION DIE

[76] Inventors: Alfred Wagner, Im Staudler 12, Steisslingen, Germany, D-7705; Hermann Kidratschky, Hombollstrasse 1, Hilzingen, Germany, D-7701

[22] Filed: Dec. 4, 1975

[21] Appl. No.: 637,594

[30] Foreign Application Priority Data

Dec. 5, 1974 Switzerland ..... 16146/74
Dec. 14, 1974 Germany ..... 2459172

[52] U.S. Cl. ..... 72/45; 72/253 R
[51] Int. Cl.[2] ..... B21C 23/32
[58] Field of Search ..... 72/41, 42, 43, 44, 45, 72/253, 272

[56] References Cited

UNITED STATES PATENTS

| | | | |
|---|---|---|---|
| 3,191,413 | 6/1965 | Stulen | 72/41 |

FOREIGN PATENTS OR APPLICATIONS

| | | | |
|---|---|---|---|
| 4,167 | 2/1893 | Sweden | 72/43 |
| 16,463 | 7/1902 | United Kingdom | 72/43 |
| 579,051 | 7/1946 | United Kingdom | 72/43 |
| 621,507 | 4/1949 | United Kingdom | 72/43 |
| 624,466 | 6/1949 | United Kingdom | 72/42 |

*Primary Examiner*—E. M. Combs
*Attorney, Agent, or Firm*—Ernest F. Marmorek

[57] ABSTRACT

The invention concerns a process and device for carrying out the process for the provision of continuous lubrication of the working surface of an extrusion die. The surface of the extrusion billet is lifted locally from the die surface during extrusion and the lubricant is introduced into the resultant dead space and from there onto the surface of the billet, the working surface of the die and throughout the die as extrusion progresses.

5 Claims, 3 Drawing Figures

DEVICE FOR CONTINUOUS LUBRICATION OF AN EXTRUSION DIE

Figure 1:
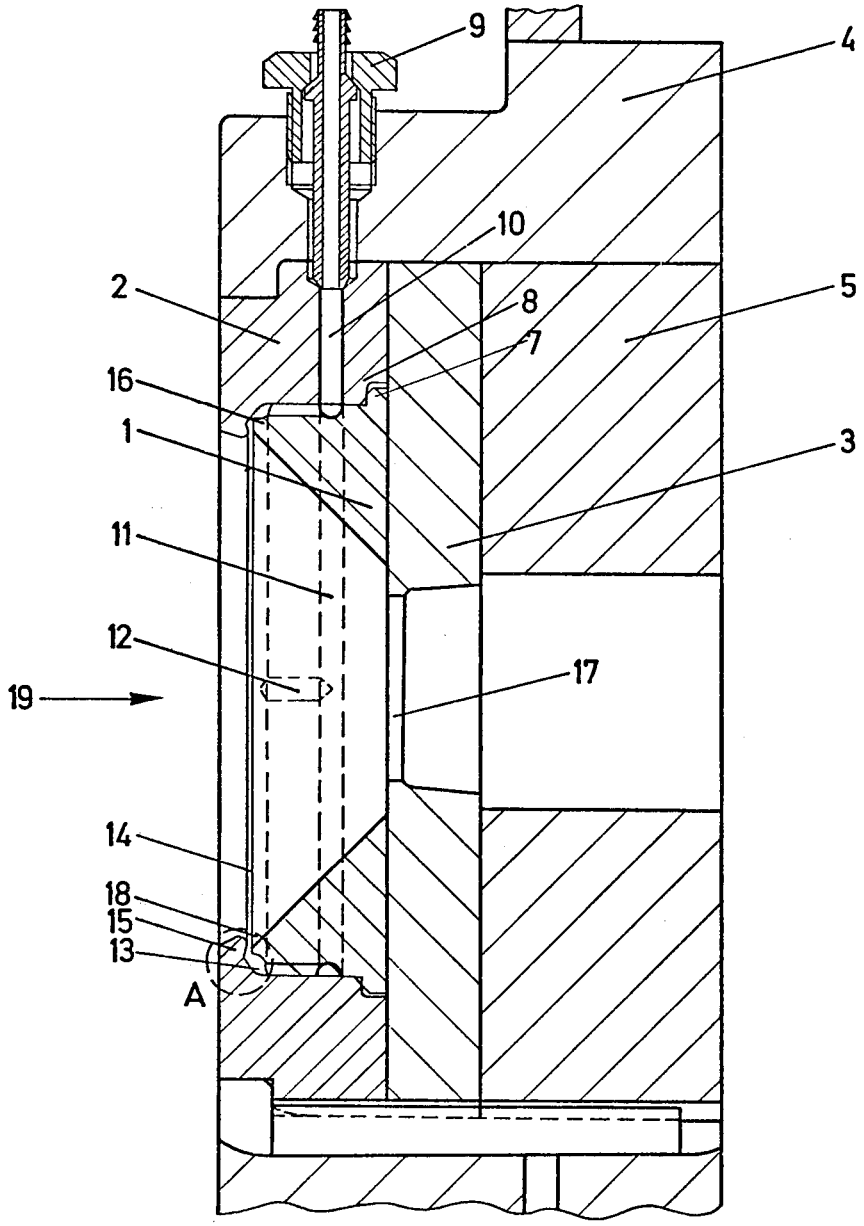

The invention concerns a process for the continuous lubrication of the working surfaces of an extrusion die which is in particular used for the production of items made out of alloys which are difficult to extrude.

In the extrusion of sections of such alloys, the chemical composition of the alloy and the prescribed surface appearance have to meet given standards. In connection with investigations aimed at optimising the extrusion process, it was found that an excessive heat of deformation in the extrusion die was directly the cause of surface flaws in the product, the flaws having several forms, one of which was transverse cracks in the section.

This heat of deformation in the extrusion die is determined basically by the rate of extrusion, which can be optimised as a function of the temperature of the extrusion billet, the specific extrusion force, the friction which exists between extruded metal and the die, and the geometry of the extrusion die. The lifetime of the die is of secondary importance with respect to the economic operation of the process, and basically depends on the same parameters as the surface appearance of the product (viz., heat of deformation, extrusion rate).

A reduction in the heat of deformation developed means, therefore, an optimisation of the process with respect to surface appearance of the product and optimisation of the lifetime of the die.

In the present stage of technological development, basically three approaches are taken to reduce the heat of deformation which is a limiting factor in production today. In each of these, it is recognized that the extrusion rate is a fixed parameter which may not be reduced, otherwise one would have to sacrifice the economic advantage of high extrusion speeds.

Firstly, an attempt was made to reduce the heat content of the extrusion billet by lowering the operating temperature of the extrusion process. This has the disadvantage that a corresponding increase in extrusion force in necessary, which is technically so expensive to provide that the economic gain made through the use of high extrusion speeds is partly or completely lost.

The second way, keeping the heat content of the extrusion billet constant and using the same, relatively, high extrusion speed, was to conduct away the undesirable excess heat of deformation from the extrusion tool by means of cooling. The contact surfaces of the die were then provided with a feed system for the supply of a coolant such as water of liquid nitrogen. This cooling system can be made in the form of a closed circuit in which a cooling device again extracts from the coolant the heat drawn off from the die. Such methods of cooling are relatively expensive to provide so that under certain circumstances they are uneconomical to use.

For a long time concentrated efforts have been made to reduce the undesired amount of heat of deformation in the extrusion die by influencing the friction between the die and the billet being extruded. Up to now, essentially three approaches have been used.

Firstly, attempts have been made to provide at regular intervals a lubricating or slippy layer to the surfaces of cooled or non-cooled dies. For this, the most commonly applied agent was graphite, which was used either alone or as a component of a specially prepared lubricant layer, if desired in combination with borides and nitrides of the material of the die.

These processes have the considerable disadvantage that after specific intervals the lubricating layer has to be renewed, which involves dismanteling the die from the extrusion press, renewing the coating on the working surface of the die and a considerable reduction in the total time-in-use of a die.

Efforts have been made therefore to increase the intervals of operation by using special substances, in order to achieve an improvement in the total time-in-use of the die. In spite of these efforts, these processes have remained time-consuming and work intensive and do not achieve the times-in-use of a die which has continuous feed of lubricant.

A further disadvantage of such solid lubricating layers is that only with considerable experience can one determined when renewal of the layer is necessary. This introduces considerable uncertainty in production with the result that even slight inattentiveness can cause expensive loss in production. If an attempt to eliminate this uncertainty is made by replacing the layer before the end of the full interval of its useful life, and thus incorporating a safety margin into the schedule, then a part of the useful time-in-use of the die is lost, and extra technical difficulties are encountered in applying the new layer because the old layer has not been completely removed.

A second known approach towards influencing the amount of friction in the extrusion die is to coat the billet, before extrusion, with a solid lubricant. For this, besides graphite, mainly glasses and glass fibres have been used. This process has the disadvantage that it is relatively difficult to apply a uniform layer of such lubricants over the billet, and also one can not always prevent such undesireable events as movement or springing-off of the layer during the heating up prior to extrusion. Furthermore, one can not ignore the danger of the lubricating layer tearing off during the extrusion process due to the increase in surface area of the metal being extruded, thus giving rise to products with variable surface appearance. One particular problem associated with this process is the supplying of the exact amount of lubricant, which can be achieved only by the appropriate choice of lubricant layer thickness on the billet. In order to avoid the uncertainty in the amount required, usually an excess of lubricant is provided, which again requires provision for the removal of excess lubricant from the product and the tool.

The continuous feed of a liquid or pasty lubricant directly on to the working surfaces of an extrusion die is difficult basically because it is necessary to have a given lubricant pressure, which is set by the specific force required in the die to deform the metal. If the lubricant is under too low a pressure, then the billet metal would penetrate the lubrication system and interfere with the whole process.

The invention presented here relates to this and has as its objective the continuous feed of a liquid or pasty lubricant to the working surfaces of an extrusion die, without requiring the pressure on the lubricant comparable with the specific pressure required for deforming the metal.

This objective is fulfilled in that the surface of the billet passing though the die is locally separated from the working surface and the lubricant is fed into the resultant dead space or zone on to the surface of the billet and the working surface of the die and, with the progression of the extrusion process, throughout the die.

From hydrodynamics it is known that when a fluid streams past an obstacle, on the downstream side of the obstacle swirling occurs and there arise pockets of low flow rate the shape of which depends on the geometry of the obstacle and the flow rate and viscosity of the fluid flowing past the obstacle. This effect is even more pronounced when the stream of material is a metal in its plastic deformation state. At the positions of dead space where the flow rate is low there occur on the downstream side of the obstacle spaces which are always completely free of the flowing medium and for this reason are not subject to the specific extrusion pressure of the metal. The shape of such dead spaces is in each case dependent on the geometry of the obstacle and the flow stress of the medium, which for a given material is dependent on the temperature, the rate of deformation (extrusion speed) and the specific extrusion force in the system.

The invention consists therefore in providing a region of small cross section in the flowing metal, by means of appropriate measures in the design of the working surface of the extrusion die, supplying lubricant to the resultant dead space and by further design features distributing this lubricant as uniformly as possible over the whole of the working surface.

It was found, surprisingly, that with such a device an exceptionally low lubricant pressure is sufficient to introduce the lubricant and is in fact several orders of magnitude lower that the specific pressure developed in deforming the metal. Thus, on extrusion of an aluminum alloy which is difficult to extrude, an extrusion force of 200 atmospheres was required but a lubricant pressure of only 1.2 atmospheres was adequate to provide satisfactory lubrication with a lubricant grease containing molybdenum disulphide. By this means, the prescribed surface appearance could be maintained in the product at an extrusion speed of 5 – 6 m/min while without lubrication the previously mentioned transverse cracks formed at an extrusion speed of 1.5 – 2 m/min.

Such a dead space for introducing the lubricant can be produced for example by the provision of a narrowing of the cross section in the metal being extruded in front of a circular running gap for the passage of the lubricant on to the working surface of the die. Because the specific force for deformation of the metal is applied at this point and the working surface of the die, where the circular running gap is situated makes an angle of 45° with the direction of extrusion, it is recommended not to have the rising part of the constriction also at 45° but to give it a surface which makes an angle of less than 45° with the direction of extrusion.

A further design possibility is to provide various designs of opening of the circular running gap for passage of the lubricant to the working surface of the die, and thus provide the possibility of regulating the amount of lubricant supplied in accordance with the needs of the specific surface finish problem.

An alternative design to a circular gap for feeding the lubricant on to the working surface of the die is the provision of a number of suitable radially placed recesses in the die chamber, the openings of which recesses to the working surface are in the form of obstacles to fluid flow and thus produce the necessary dead space.

A design intermediate to the completely circular gap are openings on the working surface of the die, which consist of several discontinuous slits each with an obstacle to flow provided.

It is of decisive importance for satisfactory distribution of the lubricant over the whole of the working surface of the die, that the die chamber narrows at an angle of 45° to make optimum use of the conical shape of this chamber, and that the openings for the lubricant are placed on the side of the pre-die chamber which is of larger diameter. This way the surface available to the lubricant becomes progressively smaller during the extrusion process and leads to increased density in lubricant, which hinders, or completely prevents, the continuity of the lubricant film from breaking down.

Uniform distribution of the lubricant over the whole of the working surface of the die, and thus the whole surface of the extruded product, requires still further precautions to be taken in design: If a continuous circular running gap is employed, then the lubricant can be fed in from outside through several inlet points in the circular gap, all of which are at the same pressure. One single inlet point can be used for the lubricant, from which the lubricant finds its way into the circular gap first via a circular running groove and then via several axially running grooves.

The supply of the lubricant takes place either via a regulating device or by hand from a conventional grease gun. By making appropriate choice of working temperature and lubricant the residues from the lubricant are small and of no consequence to the product. The small amount of residues on the extrusion tool can be removed without difficulty in the routine preparatory stages in a pickling bath of 40% caustic soda solution and in the subsequent sand blasting treatment.

An exemplified embodiment of the extrusion die of the invention is shown in the accompanying drawings and will now be described in greater detail.

Figure 2:
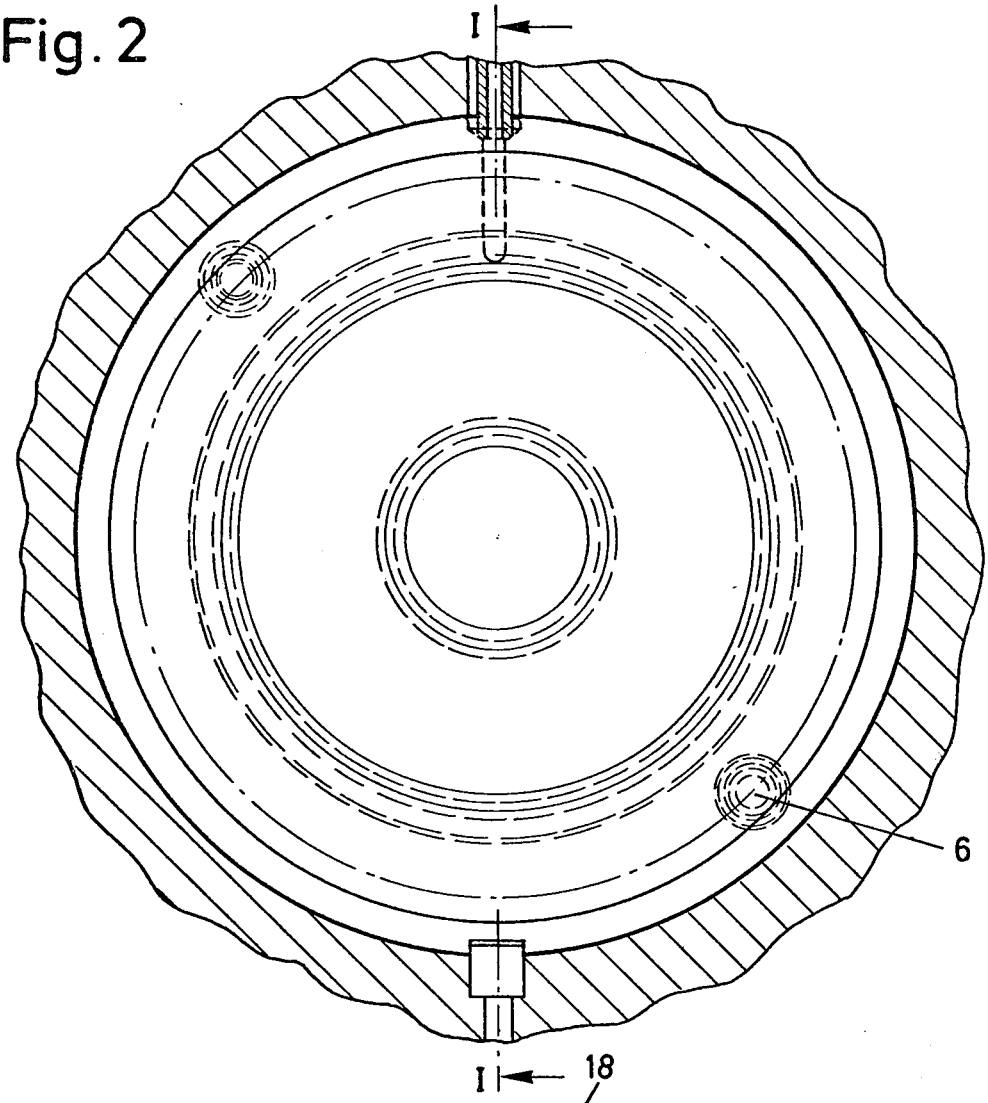

These are:

FIG. 1 A cross section along the length of an extrusion die, corresponding to the section along line I — I in FIG. 2.

FIG. 2 An end view of the extrusion die viewed from the end at which the extrusion billet enters.

Figure 3:
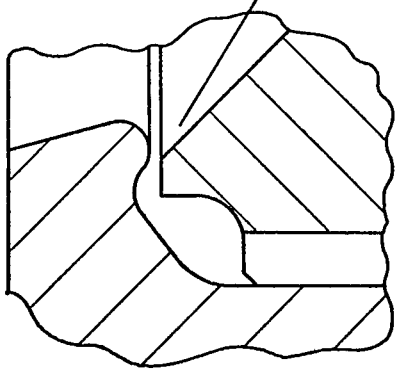

FIG. 3 An enlargement of the detail A in FIG. 1, to show more clearly the design of the entry point of the lubricant.

The extrusion die as shown in FIGS. 1 and 2 is held in a die ring 4 and consists of a die cap 3 which is braced by a bolster 5 and a pre-die ring which is in two parts viz., an inner ring 1 and outer ring 2. The outer ring 2, the die cap 3 and the bolster 5 are connected by socket head screws 6. The inner ring 1 exhibits an opening which tapers at an angle of 45° and a projection 7 which projects into a corresponding recess 8 in the outer ring 2.

The inlet port 9 for the lubricant resides in an appropriately shaped hole in the die ring 4 and the outer ring 2. A conical seating prevents undesirable escape of the lubricant between the outer ring 2, die cap 3 and die ring 4. This way the whole extrusion die is held in the die ring 4 by the inset inlet port 9.

The lubricant reaches, via a hole 10 in the outer ring 2, a semi-circular groove 11 in the inner ring 1 which runs circumferentially around the inner ring 1 and where it is then distributed over the whole of the circumferential area. Due to axially running recesses 12 in the outer face of the inner ring 1, positioned at 90° round the inner ring 1, the lubricant is forced into a torus shaped space 13 which is formed by the appropriate shaping of the contours of the inner ring 1 and outer ring 2.

By this arrangement a uniform distribution of the lubricant is assured over the whole of that surface of the inner ring 1 and the die bearing 17, which is to be lubricated.

The space 13 opens into a circular running gap 14 which is formed by the inner ring 1 and outer ring 2. As can be seen clearly in FIG. 3, this circular running gap 14 is formed by the inner ring contour 15 which is of small diameter and thus projects out, and by the larger diameter recessed contour 16 of the inner ring 1.

The result of this arrangement is that the surface of the metal, moving in the direction of the arrow, bridges the gap 14 (bridging effect) and consequently gives rise to a dead space 18 between the surface of the billet being extruded and the surface of the inner ring 1 which then permits the passage of the lubricant on to the surfaces to be lubricated under the previously mentioned, exceptionally low oil pressure. This arrangement also prevents the extruded metal which is under high pressure, from entering the lubrication system and coming out of the die on damaging the inlet port 9 through the hole 19.

As the gap 14 is of larger diameter than the die opening 17, the surface area available for the lubricant film becomes smaller as extrusion of the metal progresses through the die. This has the effect of concentrating the lubricant. The choice of opening size for the gap 14 depends on the specific extrusion force required for the deformation of the material being extruded, on the operating temperature and on the properties of the lubricant. In the example given here, the size of the opening of the gap 14 was varied between 0.2 and 0.8 mm without any notable amount of deformed metal entering the lubrication system.

EXAMPLE

The following are details of an example which should illustrate the invention further.

| | | |
|---|---|---|
| 1. | Extruded section: | Cylindrical tube, diam. 50 mm |
| 2. | Material extruded: | Si 0.4; Fe 0.30; Cu 0.05; Mn 0.1 – 0.5; Mg 4.9 – 5.6; Zn 0.1; rest Al |
| 3. | Die Material | Hot-working steel 2343 0.38% C, 1% Si, 0.4% Mn, P and S max 0.025%, 5.3% Cr, 1.1% mo, 0.4% V; rest Fe |
| 4. | Dimensions of extrusion billet: | 192 mm diameter, 410 mm in length |
| 5. | Container diameter: | 200 mm |
| 6. | Temperature of extrusions billet: | 350° C – 400° C |
| 7. | Temperature of the section leaving the die, measured 1.5 mm from the die opening: | 400° C – 420° C |
| 8. | Specified surface finish required of the section: | Depth of roughness = 8.5 μm |
| 9. | Extrusion speed — without lubrication — with lubrication | 1.5 – 2 m/min 5 – 6 m/min |
| 10. | Composition of the lubricant: | Grease containing molybdenum disulphide < 1% $MoS_2$, dropping point 260° c |
| 11. | Amount of lubricant used: | 25 – 50 cc/m of extruded section |
| 12. | Extrusion force: | 200 atm. |
| 13. | Gap for feed of lubricant (width of opening) | 0.2 – 0.8 mm |
| 14. | Lubricant pressure: | 1.2 – 1.5 atm. |

We claim:

1. A device for use in connection with the continuous lubrication of the working surface of an extrusion die during the extrusion process of a billet wherein at least a portion of said billet passing said working surface in the extrusion direction is in a plastic state, comprising, in combination:

said extrusion die defining at least one cavity near said working surface for receiving a lubricant;

said cavity being operable for receiving said lubricant under low pressure with respect to the pressure for said extrusion process; and said extrusion die defining a projection extending over said cavity with respect to said extrusion direction for reducing the flow rate of the billet material in the area of said projection independent of the extrusion pressure, whereby, during said extrusion process, said billet portion flows, retarded by said projection over said projection past said cavity defining a dead space so that said lubricant can be expelled through said dead space to said working surface at said low pressure.

2. The device as claimed in claim 1 wherein said extrusion die defines a die opening and includes an outer ring disposed in front of said die opening with respect to said extrusion direction, said outer ring defining said retarding projection as being circular.

3. The device as claimed in claim 1, wherein said extrusion die defines a circular running gap communicating with said dead space and operable for conduting said lubricant into said dead space.

4. The device as claimed in claim 3, wherein said gap includes an opening having a varying width.

5. The device as claimed in claim 3, wherein said extrusion die comprises a pre-die-face ring including two parts and said two parts define said gap.

* * * * *